US005263334A

United States Patent [19]

Kado et al.

[11] Patent Number: 5,263,334

[45] Date of Patent: Nov. 23, 1993

[54] FOOD SERVICE COUNTER OF THE ICE STORAGE TYPE

[75] Inventors: Syuji Kado, Toyoake; Susumu Tatematsu, Nagoya; Hideyuki Ikari, Kariya; Hiroyuki Sugie, Toyoake, all of Japan

[73] Assignee: Hoshizaki Denki Kabushiki Kaisha, Toyoake, Japan

[21] Appl. No.: 839,390

[22] Filed: Feb. 21, 1992

[51] Int. Cl.[5] ..... F25C 5/18

[52] U.S. Cl. ..... 62/137; 62/258; 62/344; 366/208

[58] Field of Search ..... 366/208, 213; 62/137, 62/258, 344

[56] References Cited

U.S. PATENT DOCUMENTS

| | | | |
|---|---|---|---|
| 3,144,755 | 8/1964 | Kattis | 62/137 |
| 3,192,734 | 7/1965 | Swanson | 62/137 |
| 4,227,377 | 10/1980 | Miller | 62/137 X |
| 4,860,847 | 2/1989 | Koeneman et al. | 62/132 X |

*Primary Examiner*—William E. Tapolcai

*Attorney, Agent, or Firm*—Nikaido, Marmelstein, Murray & Oram

[57] ABSTRACT

A food service counter of the ice storage type which includes an ice storage tank 20 arranged to store an amount of ice and having a discharge hole 24 at a bottom, an ice supply device 30 for automatically producing chips of ice and supplying the same into the ice tank 20, and an agitating device 40 arranged within the ice tank 20 for agitating and leveling the chips of ice stored in the ice tank 20.

10 Claims, 11 Drawing Sheets

AC 24V
DB
Cr
Qr
Rr
D
ZD
Cs
Ct
Vcc
Vo
Rx1
Rx2
Q3
Q4
Q1
Q2
D2
D3
D4
D1
IC1
IC2
IC3
IC4
IGa
IGb
DD1
DD2
DD3
DD4
C1
C2
C3
C4
C5
X33
X4

FOOD SERVICE COUNTER OF THE ICE STORAGE TYPE

BACKGROUND OF THE INVENTION

1. Field of the Invention

The present invention relates to a food service counter of the ice storage type for displaying containers, which can contain cold beverages and food, such as salad, on ice.

2. Description of the Prior Art

A conventional ice storage type food service counter of this kind is designed to display containers containing drink and food within an ice storage tank where chips of ice prepared by an ice making machine are manually carried and leveled.

Such a conventional ice storage type food service counter requires that chips of ice be manually carried into the ice storage tank and leveled, and that, every time ice melts away, ice be supplemented and leveled also manually. The ice melting is likely to tilt displayed containers, deteriorating the appearance, or spill the contents.

Since ice supplied to the ice storage tank is left as it is, the display effect is poor. There may be a system in which an ice supply device is arranged to supply ice into an ice storage tank and an agitating device is always activated to circulate and level the ice in the ice storage tank as well as to improve the display effect. In this case, however, the agitating device keeps agitating the ice so that the ice will be crashed and get harder, a so-called arching phenomenon, which overloads the agitating device, resulting in a serious accident, or degrades the quality of ice, reducing the display effect.

SUMMARY OF THE INVENTION

The present invention has been achieved with a view to solving the above problems, and it is therefore a primary object of the present invention to provide an ice storage type food service counter which is designed to automatically supply fresh ice into an ice storage tank and level it, improving the display effect as well as increasing the convenience in use of the apparatus.

It is another object of the present invention to provide an ice storage type food service counter wherein a plurality of service containers can be stably supported and easily replaced with different size containers.

It is a further object of the present invention to provide an ice storage type food service counter wherein chips of ice can be automatically supplied into an ice storage tank and leveled without causing any crash of ice chips.

According to the present invention, there is provided an ice storage type food service counter which comprises an ice storage tank arranged to store an amount of ice and having a discharge hole at a bottom; an ice supply device for automatically producing chips of ice and supplying the same into the ice tank; and an agitating device arranged within the ice storage tank for agitating and leveling the chips of ice stored in the ice storage tank.

According to one aspect of the present invention, there is provided an ice storage type food service counter which comprises an ice storage tank arranged to store an amount of ice and having a discharge hole at a bottom; an ice supply device for automatically producing chips of ice and supplying the same into the ice storage tank; at least one drive shaft penetrating the bottom of the ice storage tank from below in a liquid-tight manner to protrude into the ice storage tank and arranged to be rotated by a drive motor; at least one agitator detachably mounted on an upper end of the drive shaft in such a manner that a lower portion of the agitator is positioned in the chips of ice stored in the ice tank to agitate and level the stored chips of ice when driven by rotation of the drive shaft; and a container supported on the agitator to be placed on the ice for display and capable of containing drink and food therein.

According to another aspect of this invention, there is provided an ice storage type food service counter which comprises ice making means for forming water into chips of ice; an ice storage tank arranged to store the chips of ice supplied from the ice making means and to contain food and drink on the stored ice for refrigeration; agitating means arranged to agitate the chips of ice stored in the ice tank; a cover arranged to open and close the ice tank; detecting means for detecting when the cover is closed and for releasing the detection when the cover is opened; and control means for controlling the agitating means in such a manner as to activate the agitating means to perform agitation of the chips of ice only in operation of the ice making means when closure of the cover is detected by the detecting means and to activate the agitation means to perform agitation of the chips of ice while the detection is being released by the detecting means.

DETAILED DESCRIPTION OF THE PREFERRED EMBODIMENTS

Figure 1:
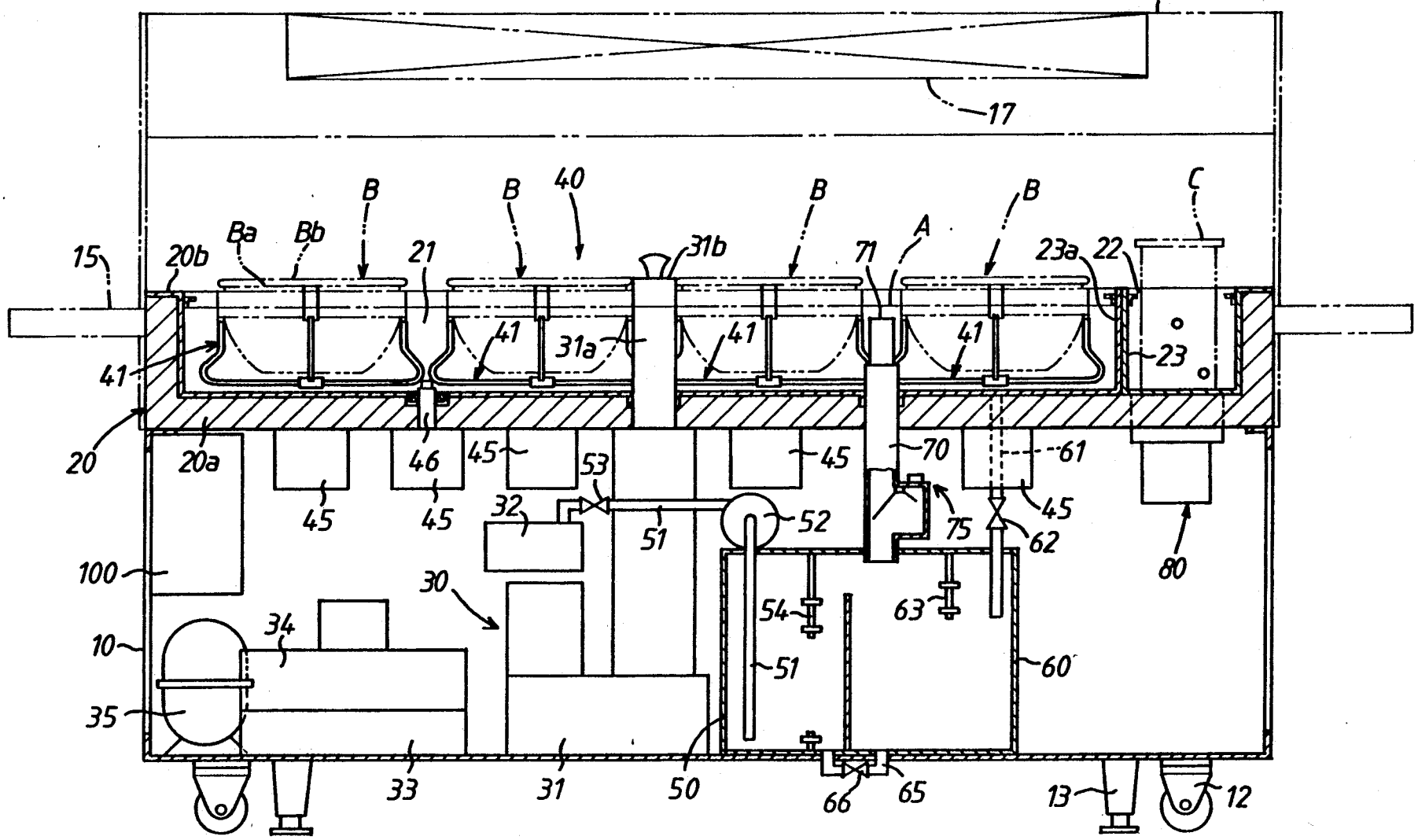
FIG. 1 is a vertical sectional view illustrating essential portions of an ice storage type food service counter according to a first embodiment of the present invention.
Figure 2:
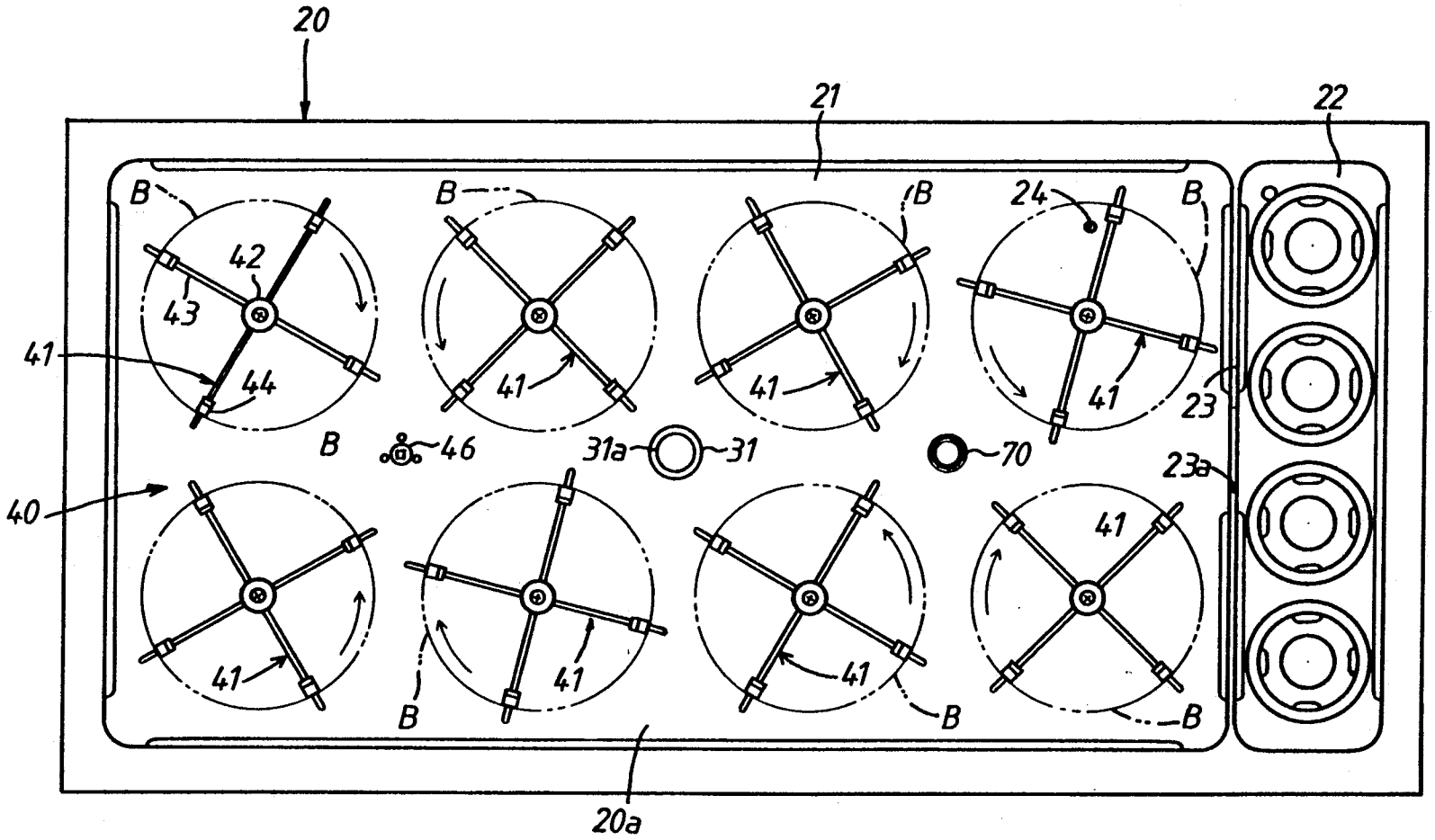
FIG. 2 is a plan view of the service counter.

A first embodiment of the present invention will now be described referring to the accompanying drawings. FIGS. 1 and 2 exemplify an ice storage type food service counter according to the present invention. As shown in FIG. 1, an ice storage tank 20 is fixed on the top of a support frame 10, which is supported on the floor by casters 12 and legs 13. Disposed in the support frame 10 under the ice tank 20 are an ice supply device 30 for continually supplying chips of ice to the ice storage tank 20, a water supply tank 50, a discharge tank 60, a control device 100, etc. as well as the essential portions of an agitating device 40 which agitates ice supplied into the ice storage tank 20 to level it. A table 15 is provided around the ice storage tank 20. Above the ice storage tank 20 is located an open type hood 16 provided with lighting equipment 17.

As shown in FIGS. 1 and 2, the ice storage tank 20 comprises an insulative outer box lined with a rust preventive material, such as stainless steel or resin, shaped into a rectangular shallow box with the top open. Part of the line of the ice tank 20 stands upright to form a partition 23 which separates the interior of the ice tank 20 into a large main tank 21 and a small sub tank 22. A notch 23*a* is formed in the center of the upper edge of the partition 23 to permit communication between both tanks 21 and 22. The lower edge of the notch 23*a* is positioned slightly lower than a predetermined ice level A to be described later. As shown in FIG. 2, a discharge hole 24 is formed in the bottom of main tank 21. The sub tank 22 may be omitted depending on the usage.

The ice supply device 30 of this embodiment is a well-known auger type ice making machine whose essential portions include an ice making mechanism 31, a water tank 32, a condenser 33, a cooling fan 34 and a compressor 35, which are all disposed within the support frame 10, except for the top portion of the ice making mechanism 31. The ice making mechanism 31 comprises an evaporator, an auger and a drive motor. A cylinder 31*a* extending vertically penetrates a bottom plate 20*a* of the ice storage tank 20 in a liquid-tight manner into the main tank 21. The cylinder 31*a* has an ice delivery port 31*b* provided at the top, slightly higher than an upper edge 20*b* of the ice storage tank 20. As will be described later, ice making water supplied to the water tank 32 from the water supply tank 50 is supplied to the ice making mechanism 31 where it is formed into chips of ice of the size of about 1 to 2 cm, and the chips of ice are carried up to fall inside the main tank 21 from the ice delivery port 31*b*.

As shown in FIGS. 1 and 2, the agitating device 40 comprises agitators 41 respectively mounted on a plurality of drive shafts 46, and drive motors 45 for rotating the agitators 41. In this embodiment, there are nine geared motors used as the drive motors 45, with their output shafts being the drive shafts 46. Each drive motor 45 is fixed to the bottom of the ice tank 20, with the drive shaft 46 penetrating the bottom plate 20*a* in a liquid-tight manner so that its tip protrudes slightly inside the ice storage tank 20. As shown in FIG. 2 of a plan view, the individual drive shafts 46 are arranged eight in two rows at equal lateral and longitudinal distances and the last one located just the center of those four drive shafts which are located away from the sub tank 22 than the other four. Each drive shaft 46 has a rectangular free end where the associated agitator 41 is to be mounted. Although, in this embodiment, each drive shaft 46 is driven by a single drive motor 45 and its rotational speed and direction can be finely adjusted by the control device 100, the individual drive shafts 46 may be linked by a link mechanism to be driven by fewer drive motors.

As shown in FIGS. 1 and 2, the agitator 41 has a boss section 42 to be detachably attached to the free end of the drive shaft 46, four arm portions 43 having one end fixed to the boss section 42 and extending radially before bent upward, and stoppers 44 pivoted on the upper ends of the respective arm portions 43. The individual agitators 41, except the stoppers 44, are positioned in the ice stored in the ice tank 20 to a predetermined level (to be described later). Each boss section 42 has a rectangular hole in the center in which the top end of the drive shaft 46 is to be fitted, and is securely fastened to the drive shaft 46 by means of a screw. As shown mainly in FIG. 1, the arm portion 43 of the agitator 41 mostly extends in the radial direction close to the bottom of the main tank 21, and its outer end is bent inward at the time it is bent upward after reaching further out than the stopper 44. This design is taken to increase the area to contact the ice, thereby improving the ice agitating effect which will be discussed later. The rotational speed of the agitator 41 is several rotations per minute. The agitator 41 is in no way limited to this particular shape, but may be modified to have various other shapes. While the rotational directions of the individual agitators 41 are determined such that the adjoining agitators rotate in the opposite directions as illustrated in FIG. 2, the agitators may rotate with various other direction patterns.

Containers B each comprise a transparent glass support container Ba and a service container Bb. The support container Ba is attached to the associated agitator 41 with its edge portion held by the stopper 44, and is designed to receive the service container Bb which contains cold food and drink, such as salad. It is preferable that water be put between both containers Ba and Bb to increase the heat transmission. While the water supply tank 50 and discharge tank 60 are provided by separating a single container with a partition in this embodiment as shown in FIG. 1, they may be independent and separate tanks. The tanks 50 and 60 each have a water supply level detector 54 and a water discharge level detector 63, and the bottoms of both tanks 50 and 60 communicate with each other through a communication path 65 provided with a solenoid valve 66. The tanks 50 and 60 are each provided with a drain cock (not shown). Water in the water supply tank 50 is supplied to the water tank 32 via a water supply pump 52 and a supply line 51 equipped with a water supply solenoid valve 53. The level of water in the water tank 32 is kept almost constant by controlling the pump 52 and the solenoid valve 53 by means of a float switch (not shown) which is activated when the water level in the water tank 32 becomes a predetermined level. The discharge hole 24 in the bottom of the main tank 21 communicates with the interior of the discharge tank 60 through a discharge path 61 provided with a discharge solenoid valve 62, so that water produced by melted ice in the main tank 21 is discharged into the discharge tank 60.

As shown in FIGS. 1 and 2, an overflow pipe 70 is provided vertically in the ice tank 20, penetrating the bottom plate 20*a* in a liquid-tight manner. The overflow pipe 70 has an opening 71 at its upper end, slightly lower than the upper edge 20*b* of the ice tank 20, and a lower end opening into the interior of the discharge tank 60. When the level A of chips of ice, supplied from the ice supply device 30 into the main tank 21 and leveled by the agitating device 40, reaches a predetermined level slightly higher than the opening 71 at the upper end of the overflow pipe 70 (but lower than the upper edge 20*b*), individual chips of ice fall in the discharge tank 60 after passing through the overflow pipe 70. In the midway of the overflow pipe 70 is provided an ice detector 75 which comprises a flapper lightly pressed against the inner wall of the overflow pipe 70 by means of springs and a proximity switch. The sub tank 22 is arranged to receive four dressing containers C, with an agitating device 80 provided below the sub tank 22.

When the ice storage type food service counter according to the first embodiment is operated, water in the water supply tank 50 is fed by the pump 52 to the water tank 32 from which it is supplied to the ice making mechanism 31 to be formed into chips of ice. The chips of ice are then supplied into the main tank 21 from the ice delivery port 31*b*, and, at the same time, are automatically distributed all over the interior of the main tank 21 and leveled with the rotation of the agitators 41. When the ice level A in the main tank 21 reaches a predetermined level, those pieces of ice above that level falls into the discharge tank 60 via the overflow pipe 70. When the passing of ice is detected by the ice detector 75, the control device 100 stops the activation of the ice making mechanism 31 for a given period of time to keep the ice level A at the predetermined level. In such a situation, the ice storage type food service counter is used with the food and drink containing service container Bb placed in the support container Ba.

According to the ice storage type food service counter of the first embodiment, since chips of ice fall via the ice delivery port 31*b* into the ice tank 20 piece by piece and the ice moves around by the action of the agitators 41, an excellent display effect will be acquired as well as the food and drink in the service container Bb can be refrigerated.

According to the first embodiment, a pool of water made by ice melted in the main tank 21 is discharged from the discharge hole 24 into the discharge tank 60 through the discharge path 61 and solenoid valve 62. When the level of water in the discharge tank 60, which is detected by a water discharge level detector 63, becomes the highest allowable level, the control device 100 closes the solenoid valve 62 to prevent water leak to the outside from the discharge tank 60. In this case, the use of the ice storage type food service counter need not be stopped immediately, but may continue with the agitating device 40 in operation for some time.

Figure 3:
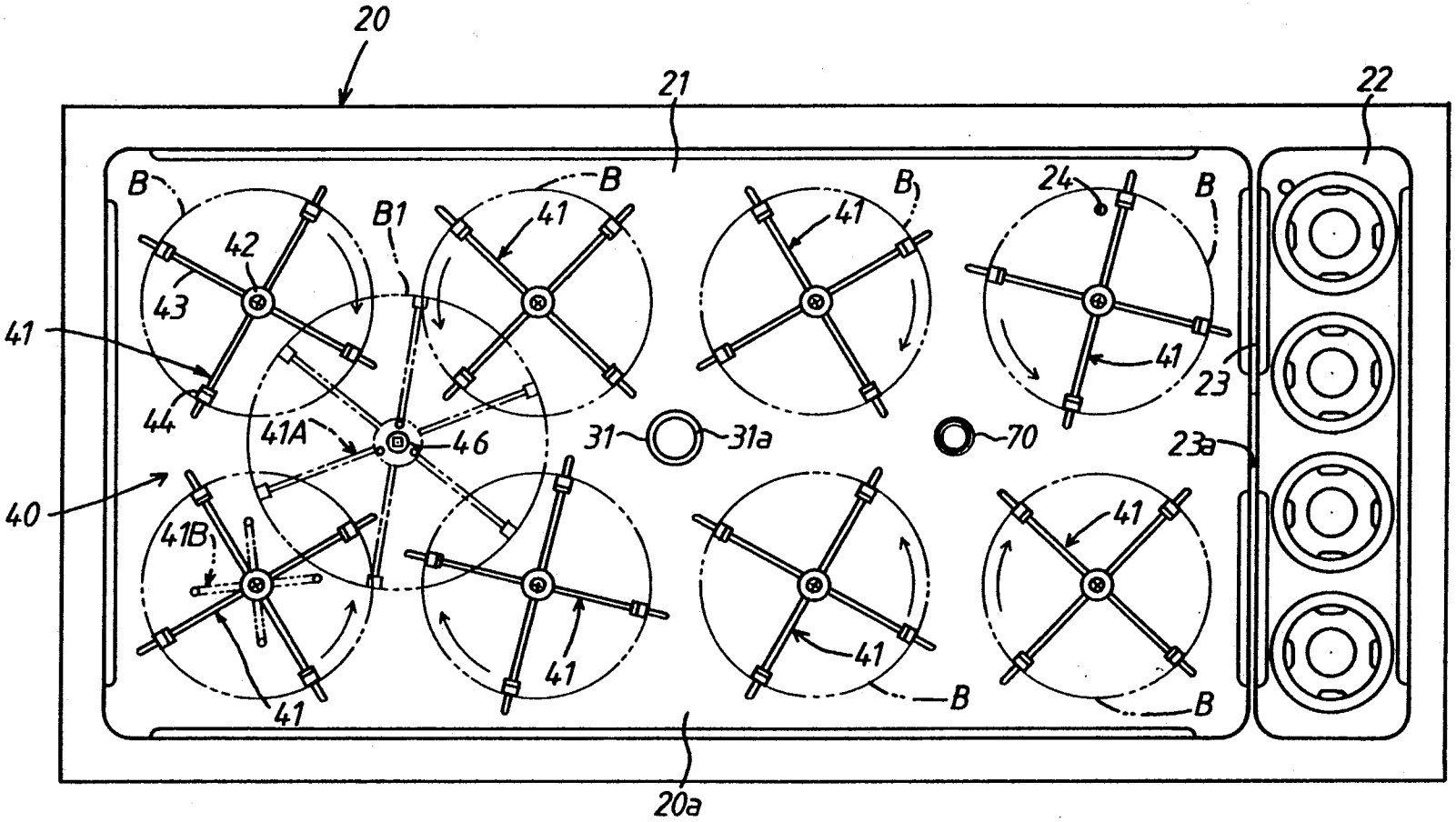
FIG. 3 is a plan view showing a modification of the service counter.

Although the agitator 41 is not mounted on the drive shaft 46 in the left center in FIG. 2 in the above embodiment, the drive shaft 46 is reserved for the use to mount, for example, a large agitator 41A for supporting a large-diameter container B1 as indicated by an imaginary circular line in FIG. 3, in which case small agitators 41B (only one shown) are mounted on the surrounding four drive shafts 46, or no agitators are mounted thereon. Alternatively, the small agitators 41*b* for supporting small-diameter containers B may be mounted on those five drive shafts 46. It is needless to say that each of the agitators to be mounted on the drive shafts at the same time should not substantially interfere with the rotation of another.

When it is desired to mount the large-diameter container B1 on the drive shaft 46 in the left center as indicated by the imaginary circular line in FIG. 3, the agitators 41 are removed from the surrounding four drive shafts 46 for replacement with the small agitators, and the large-diameter agitator 41A is mounted on the center drive shaft 46 to support the container B1 thereon. Since the individual agitators 41, 41A and 41B are detachably mounted on the upper ends of the drive shafts 46 by means of screws, the attachment and detachment of the individual agitators for replacement is very easy.

In this case, each of the containers B and B1 is separated into the support container Ba and the service container Bb in such a way that the former container Ba is mounted on the associated agitator 41 or 41A with the service container Bb placed in the container Ba. The individual containers B and B1 may each be designed as a single type, so that they are directly attached to the associated agitators 41 and 41A with their edge portions held by the stoppers 44.

Figure 4:
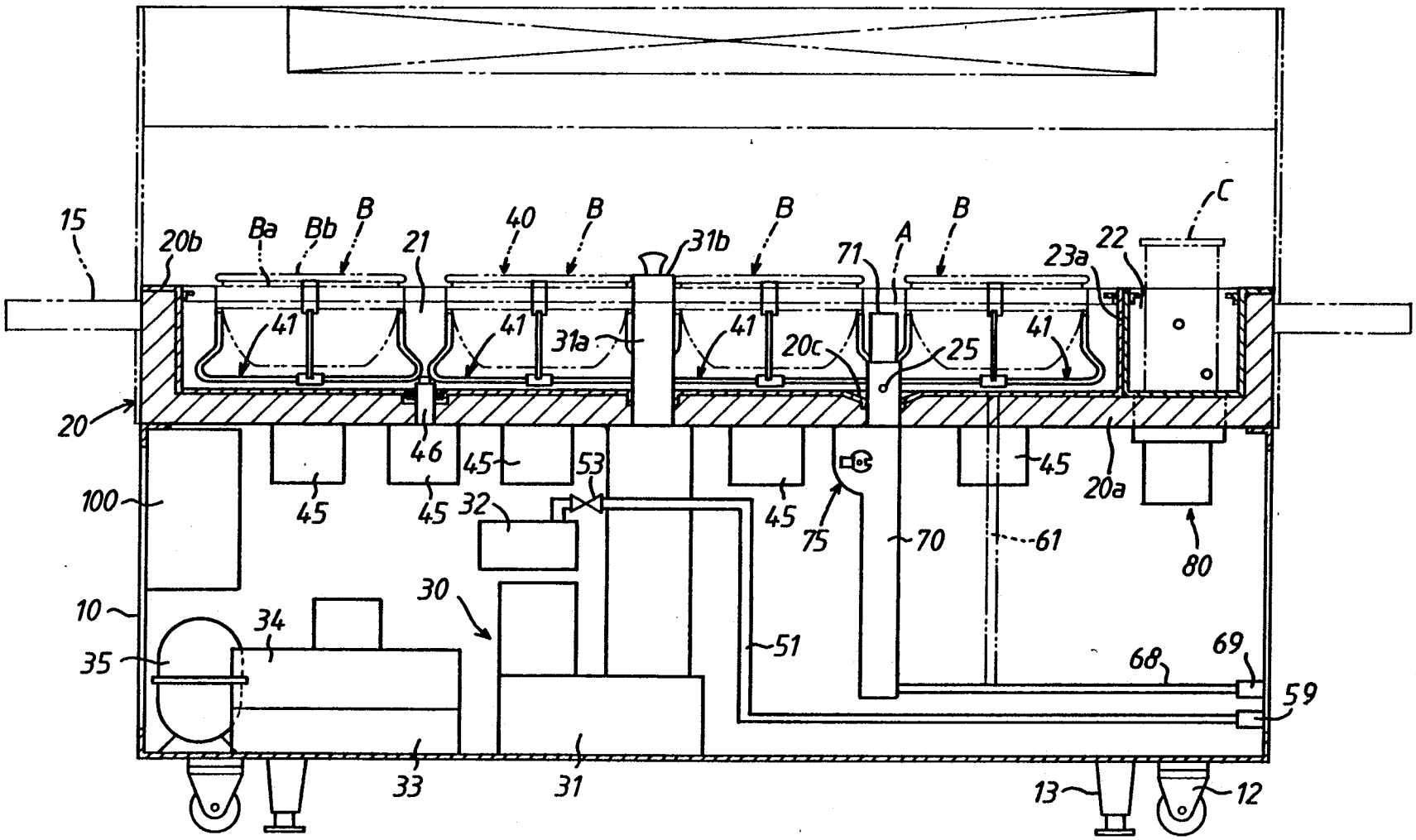
FIG. 4 is a vertical sectional view illustrating essential portions of an ice storage type food service counter according to a second embodiment of the present invention.
Figure 5:
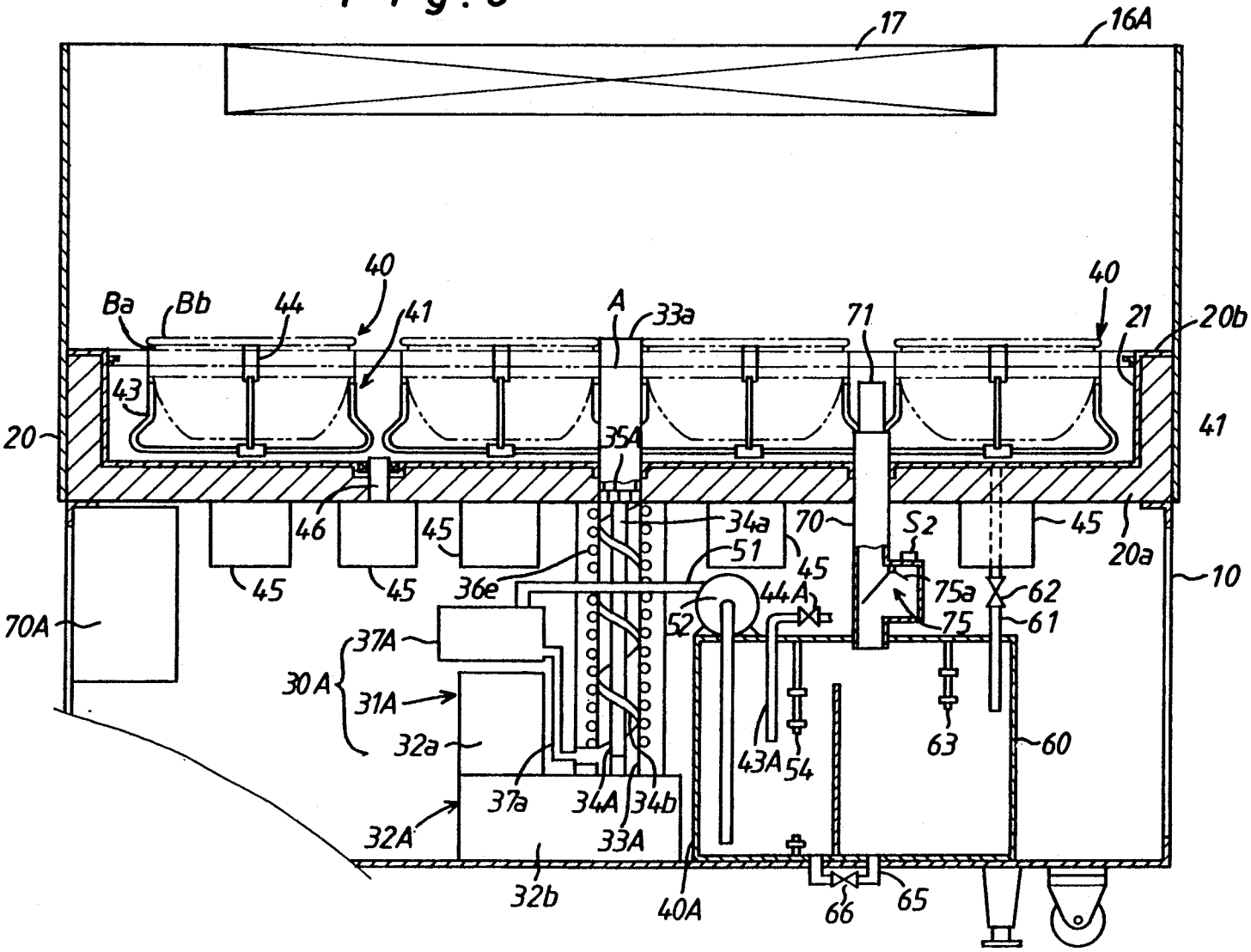
FIG. 5 is a partly broken vertical sectional view illustrating essential portions of an ice storage type food service counter according to a third embodiment of the present invention.
Figure 6:
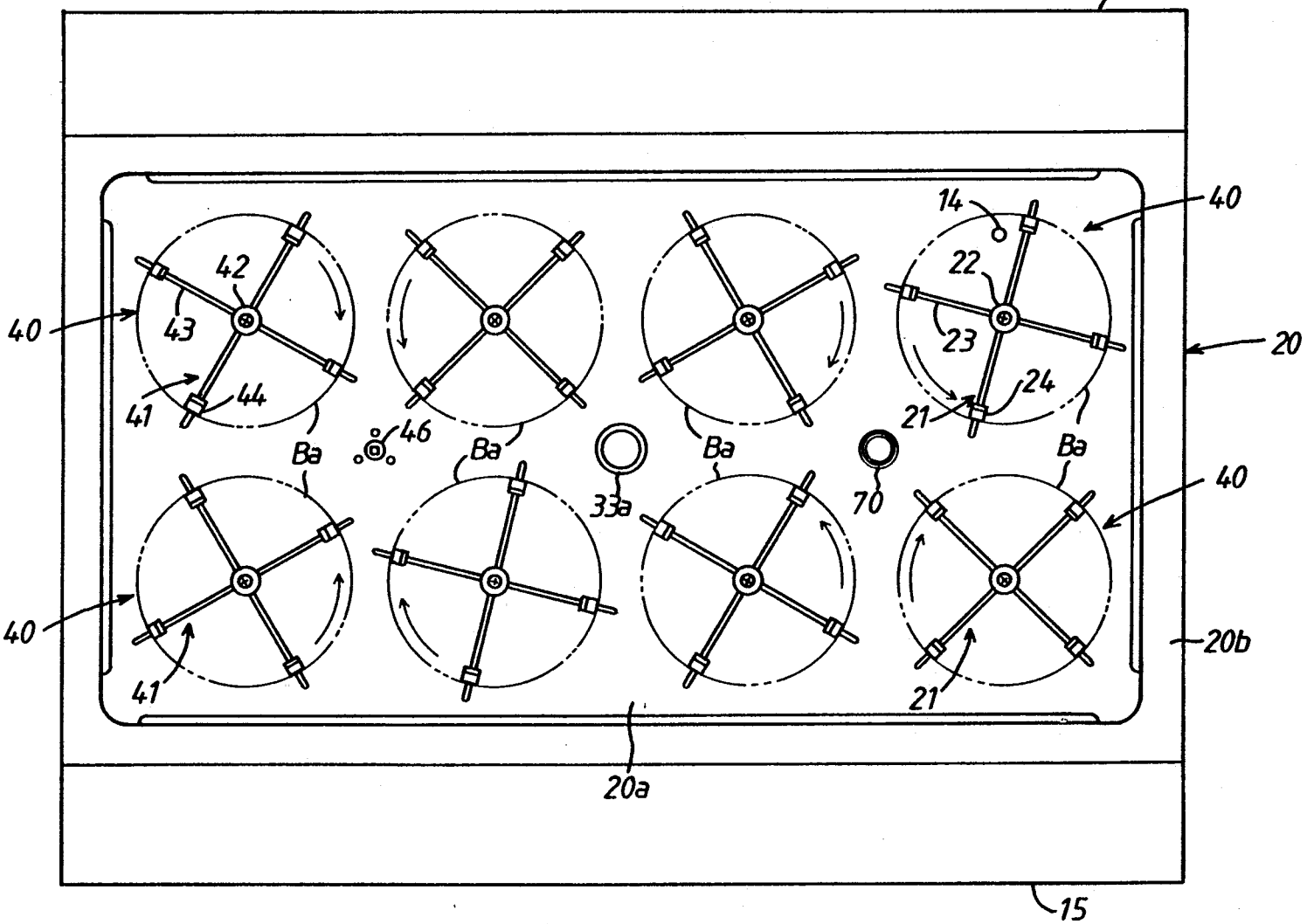
FIG. 6 is a plan view of the service counter.

While the first embodiment has the water supply tank 50 and the discharge tank 60 to allow for its free movement and use at any location, a second embodiment as shown in FIG. 4 supplies water to the water tank 32 directly from a water pipe and discharges water to the outside directly. In the second embodiment, a water supply union 59 attached to the support frame 10 for connection to an external water pipe is linked to the water tank 32 via the supply line 51 equipped with the water supply solenoid valve 53 in its midway, as shown in FIG. 4. The overflow pipe 70 extends downward and has its lower end portion connected via a discharge pipe 68 to a discharge union 69 attached to the support frame 10. In this embodiment, a conical recess 20*c* is formed in the bottom of the main tank 21 which is close to where the overflow pipe 70 penetrates the bottom plate 20*a* in a liquid-tight manner, and a discharge hole 25 is bored in the peripheral wall of the overflow pipe 70 to discharge water produced by melted ice. The discharge hole 25 may be provided in the bottom of the main tank 21 as in the first embodiment, to be connected to the discharge path 61 as shown by an imaginary line in FIG. 4. The discharge solenoid valve 62 is not necessary in the second embodiment.

Although the ice detector 75 is provided in the overflow pipe 70 in the above embodiments, the overflow pipe may be omitted in which case a detector for detecting the ice level A should be provided separately so that the ice supply device 30 is caused to stop when the ice level A reaches a predetermined level and it is caused to start when the ice level A drops. Furthermore, the number of the ice supply device 30 is not limited to one, but, for a large ice storage type food service counter or the type which is used under a high-temperature environment, a plurality of ice supply devices 30 may be provided to supply chips of ice into the ice tank 20 from multiple ice delivery ports 31*b*. The ice delivery port 31*b* can serve its purpose even if located below the ice level A as long as it is positioned higher than the discharge hole 25.

Figure 7:
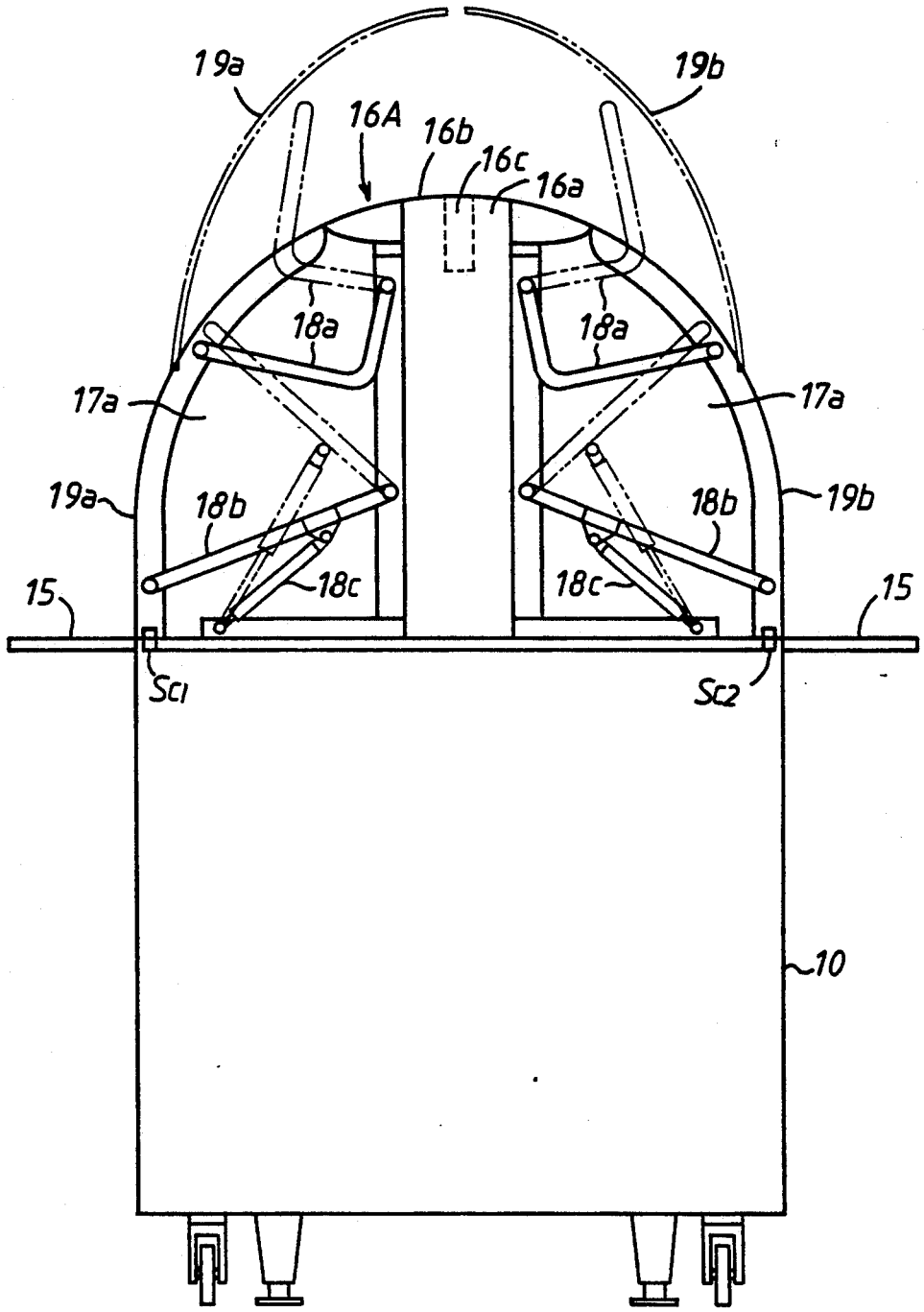
FIG. 7 is a partly broken side view of the service counter.

A third embodiment of the present invention will be described below referring to FIGS. 5 to 12. A hood 16A corresponds to the hood 16 in the first embodiment. As shown in FIG. 7, this hood 16A has two supports 16*a* provided upright vertically at the center portions of the right and left sides of the ice tank 20, a link portion 16*b* which couples the top ends of both supports, two side plates 17*a* provided on the respective sides of the supports, and two covers 19a and 19b provided on the front and back to be movable upward. The covers 19a and 19b are coupled to the supports 16a by L-shaped plate members 18a and straight plate members 18b. The plate members 18b are coupled to the bottoms of the side plates 17a by stretchable gas spring members 18c. The covers 19a and 19b can therefore be opened or closed easily manually due to the stretchability of gas spring members 18c. The lighting equipment 17 as mentioned in the description of the first embodiment is provided at the lower end portion of the link portion 16b.

The ice supply device 30A is in the form of an auger type ice making machine corresponding to the ice supply device 30 in the first embodiment. This ice supply device 30A comprises an ice making mechanism 31A, a refrigeration circuit 36A, a water tank 32, etc., and is disposed within the support frame 10 except the upper portion of the ice making mechanism 31A. The ice making mechanism 31A comprises a geared motor 32A, a cylindrical housing body 33A vertically mounted on the casing of the geared motor 32A, an auger 34A rotatably mounted within the cylindrical housing body 33A, an extrusion head 35A fixedly mounted on the cylindrical housing body 33A at the upper end portion of the auger 34A, and an evaporator 36e wound around the cylindrical housing body 33A. The geared motor 32A includes an auger drive motor 32a and a reduction gear 32b. The auger drive motor 32a transmit its rotation to the reduction gear 32b, which reduces the rotation speed to a predetermined low speed.

The cylindrical housing body 33A has a water inlet connected at its lower portion to a water supply pipe 37a extending from a water tank 37A so that water is supplied from the water tank 37A in the cylindrical housing body 33A to a predetermined level. The water tank 37A receives clean water pumped up from a water supply tank 40A (to be described later) by the water supply pump 52, and the water level in the water tank 37A is maintained at or below a predetermined upper water level by a float switch FS to be described later. The cylindrical housing body 33A penetrates the bottom plate 20a of the ice tank 20 in a liquid-tight manner and extends into the main tank 21, with its ice delivery port 33a at the upper end positioned slightly above the upper edge 20b of the main tank 21.

The auger 34A comprises a rotary shaft 34a supported coaxially and rotatably within the cylindrical housing body 33A and a helical blade 34b formed on the rotary shaft 34a, which is coupled at its lower end with the output shaft of the reduction gear 32b. The auger 34A sequentially scrapes ice crystals produced in the cylindrical housing body 33A and advances them upward by means of the helical blade 34b in accordance with rotation of the rotary shaft 34a driven by the geared motor 32A. The extrusion head 35A is fixed in place within the upper portion of the cylindrical housing body 33A coaxially with the rotary shaft 34a of auger 34A. The extrusion head 35A acts to compresses the scraped ice advanced by the auger 34A to form chips of ice of about 1 to 2 cm in size.

Figure 8:
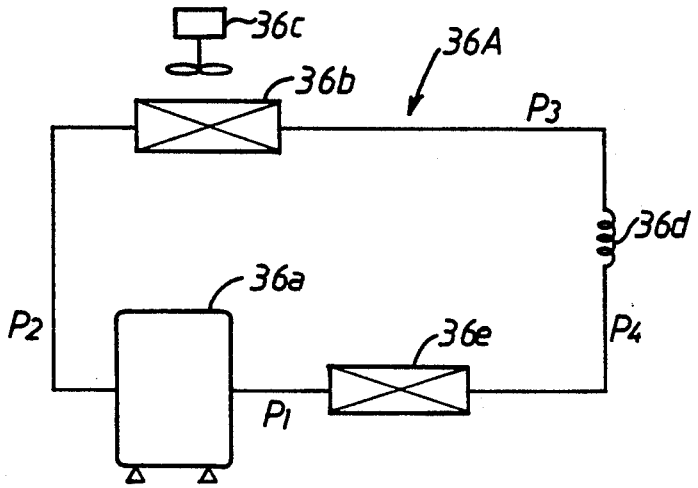
FIG. 8 is a diagram showing a refrigeration circuit of the service counter.
Figure 12:
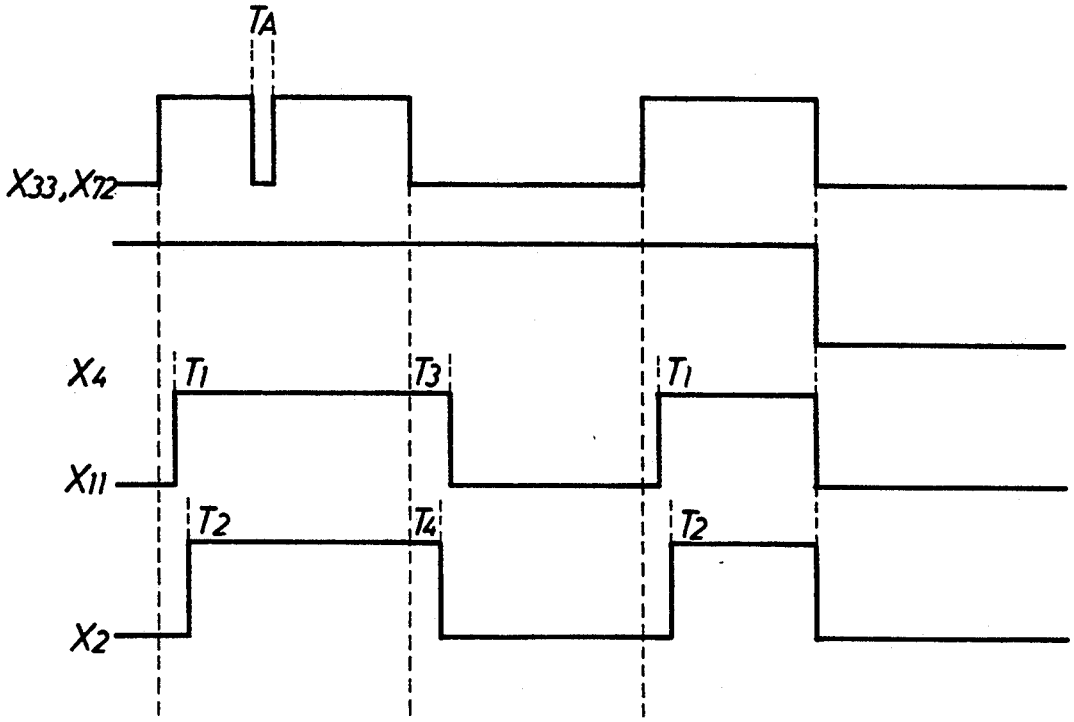
FIG. 12 is a time chart illustrating operation of individual components of the electric circuit shown in FIG. 9.

The evaporator 36e, which is one component element of the refrigeration circuit 36A, freezes water in the cylindrical housing body 33A into crystals of ice due to the evaporation effect of refrigerant circulating in the refrigeration circuit. As shown in FIG. 8, the refrigeration circuit 36A has a compressor 36a, a condenser 36b, a pressure reducing device 36d and the evaporator 36e, as shown in FIG. 8. The compressor 36a is driven by a compressor drive motor 36a1 to suck and compress the refrigerant from a pipe $P_1$, and discharges the refrigerant into a pipe $P_2$. The condenser 36b condenses the compressed refrigerant from the pipe $P_2$ under the cooling effect of a cooling fan 36c and puts it in a pipe $P_3$. The pressure reducing device 36d reduces the pressure of the condensed refrigerant in the pipe $P_3$, and supplies it via a pipe $P_4$ to the evaporator 36e. The evaporator 36e then evaporates the refrigerant with reduced pressure to supply it into the pipe $P_1$.

The water supply tank 40A has substantially the same structure as the water supply tank 50 described in the first embodiment, except that the tank 40A receives clean water from an external water source (not shown) via a solenoid valve 44A and a water supply pipe 43A. The other mechanical structure of the display apparatus according to the third embodiment has substantially the same structure as that of the first embodiment, except that the sub tank 22 and dressing container C are omitted.

An electric circuit of the control device 70A in the ice storage type food service counter will be described with reference to FIGS. 9 through 12. A switch $S_1$ is connected via common leads $L_1$ and $L_2$ to an electric power source to supply the power to individual electric circuit elements when it has been closed. A proximity switch $S_2$ of the ice detector 75 is arranged to be closed when the ice level A in tank 20 becomes higher than a predetermined level where chips of ice fall into the discharge tank through the overflow pipe 70. A timer circuit 71A comprises a timer 71a and a normally open time limit switch 71b. The timer 71a has one end connected via the proximity switch $S_2$ to the common lead $L_1$ and the other end connected to the common lead $L_2$. When applied with the power, the timer 71a starts to measure a predetermined time. The normally open time limit switch 71b is closed when the timer 71a starts to measure the predetermined time and is opened when the measurement is completed.

A relay coil $R_{x7}$ is associated with a normally open relay switch $X_{71}$ and a normally closed relay switch $X_{72}$. The relay coil $R_{x7}$ has one end connected to the common lead $L_1$ via a parallel circuit of the proximity switch $S_2$ and the relay switch $X_{71}$ and the other end connected to the common lead $L_2$ via the normally open time limit switch 71b and is energized when applied with the power from the electric power source. The relay switch $X_{71}$ is arranged to be closed by energization of the relay coil $R_{x7}$, while the relay switch $X_{72}$ is arranged to be opened by energization of the relay coil $R_{x7}$.

The agitator drive motor 45 and lighting equipment 17 each have one end connected to the common lead $L_1$ via a parallel circuit of cover switches $Sc_1$ and $Sc_2$ and a normally open type relay switch $X_{12}$ and the other end connected to the common lead $L_2$. The cover switches $Sc_1$ and $Sc_2$ are in the form of proximity switches which are mounted on the upper edge 20b of the ice tank 20 to be closed when the covers 19a and 19b are opened and to be opened when the covers 19a and 19b are closed. The cover switches $Sc_1$ and $Sc_2$ are not limited to the proximity switches, but may be photoelectric switches or the like. A normally open relay switch $X_{12}$ is associated with a relay coil $R_{x1}$ to be closed by energization of the relay coil $R_{x1}$. The agitator drive motor 45 is arranged to be driven by the power applied from the electric power source when the relay coil $R_{x1}$ has been energized or the cover switches $Sc_1$ and $Sc_2$ have been closed.

The discharge level detector 63 in the discharge tank 60 comprises a normally closed float switch $FS_5$ arranged to be opened upon detection of a predetermined first water level and a normally closed float switch $FS_6$ arranged to be opened upon detection of a predetermined second water level slightly higher than the first water level. A relay coil $R_{x5}$ is associated with a normally open relay switch $X_5$ which has one end connected via the float switch $FS_5$ to the common lead $L_1$ and the other end connected to the common lead $L_2$. A relay coil $R_{x6}$ is associated with a normally open relay switch $X_6$ which has one end connected via the float switch $FS_6$ to the common lead $L_1$ and the other end connected to the common lead $L_2$. A discharge solenoid valve 62 has one end connected via the relay switch $X_6$ to the common lead $L_1$ and the other end connected to the common lead $L_2$. When the level of water in the discharge tank 60 reaches the second water level, the discharge solenoid valve 62 is closed by the power applied thereto from electric power source.

The float switch FS in the water tank 37A comprises a normally open upper float switch $FS_1$ and a normally open lower float switch $FS_2$. The float switch $FS_1$ is arranged to be closed upon detection of a predetermined upper water level, while the float switch $FS_2$ is arranged to be closed upon detection of a predetermined lower water level. A relay coil $R_{x3}$ is associated with normally open relay switches $X_{31}$ and $X_{33}$ and a normally closed relay switch $X_{32}$. The relay coil $R_{x3}$ has one end connected via the relay switch $X_5$ and float switch $FS_1$ to the common lead $L_1$ and the other end connected to the common lead $L_2$. The relay switches $X_{31}$ and $X_{33}$ are arranged to be closed by energization of the relay coil $R_{x3}$, while the relay switch $X_{32}$ is opened by energization of the relay coil $R_{x3}$.

The water supply pump 52 has one end connected via the normally closed relay switch $X_{32}$ and the normally open relay switch $X_5$ to the common lead $L_1$ and the other end connected to the common lead $L_2$. The water supply pump 52 is arranged to be driven by the power applied thereto from the electric power source when the water level in the discharge tank 60 is at or below the first predetermined level in a condition where the relay switch $X_5$ is closed or when the water level in the water tank 37A is at or below the predetermined lower level in a condition where the relay switch $X_{32}$ is closed. The auger drive motor **32*a* has one end connected via a normally open relay switch $X_{11}$ to the common lead $L_1$ and the other end connected via a protector $OL_2$ for protection from overheat to the common lead $L_2$. When the relay switch $X_{11}$ is closed, the auger drive motor 32*a*** is driven by the power applied thereto from the electric power source. The relay switch $X_{11}$ is associated with the relay coil $R_{x1}$ to be closed by energization of the relay coil $R_{x1}$. A relay coil $R_{x4}$ is associated with a normally open relay switch $X_4$. The relay coil $R_{X4}$ has one end connected to the common lead $L_1$ and the other end connected via the protector $OL_2$ to the common lead $L_2$. The relay switch $X_4$ is arranged to be closed by energization of the relay coil $R_{x4}$.

The compressor drive motor **36*a*1 has one end connected via a normally open relay switch $X_2$ to the common lead $L_1$ and the other end connected via a protector $OL_1$ for protection from overheat to the common lead $L_2$. A fan motor 36*c*1 for cooling the condenser 36*b*** has one end connected via the relay switch $X_2$ to the common lead $L_1$ and the other end connected to the common lead $L_2$. The relay switch $X_2$ is associated with a relay coil $R_{x2}$ to be closed by energization of the relay coil $R_{x2}$.

Figures 10, 11:
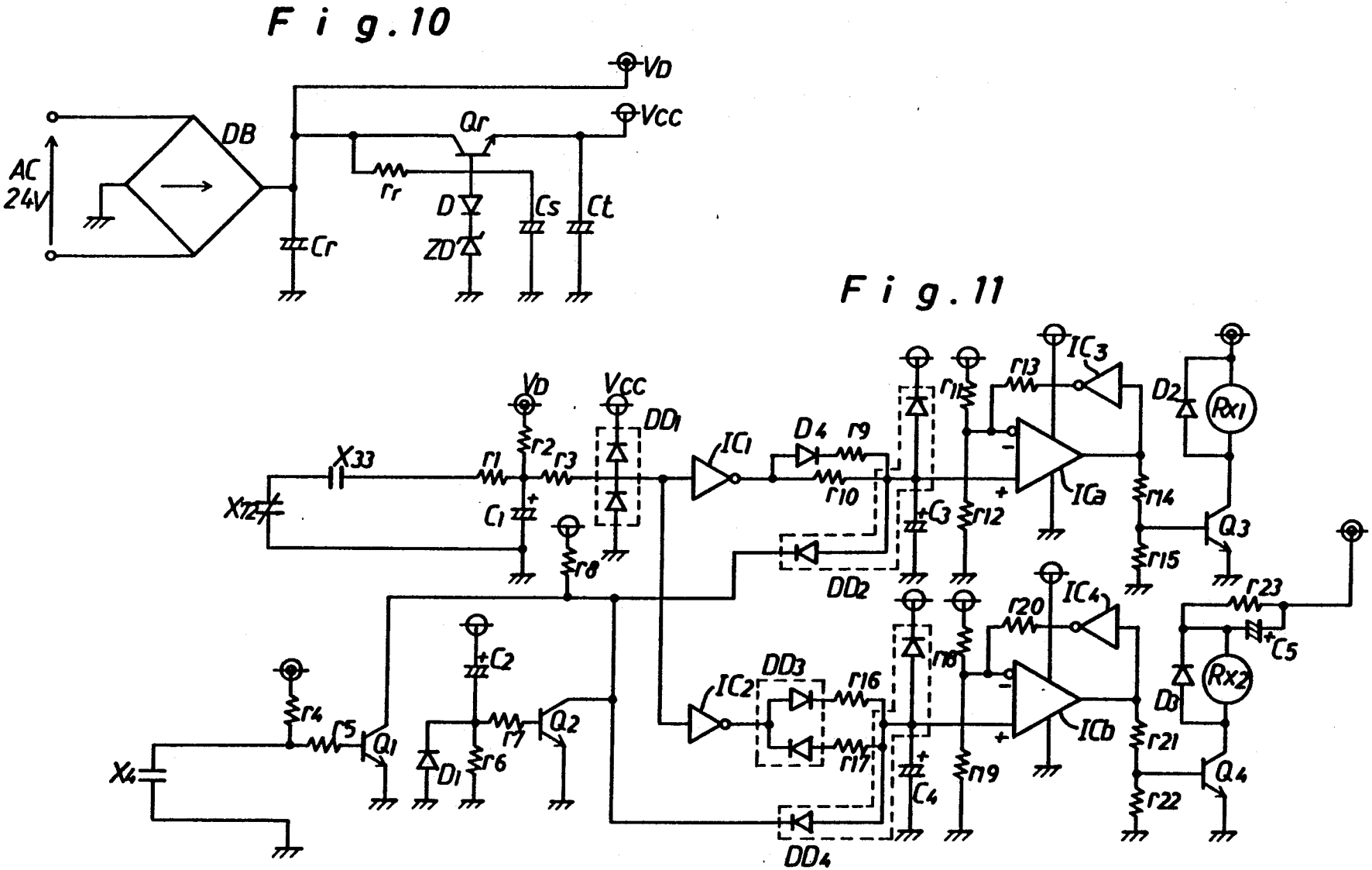
FIG. 10 is a detailed diagram of a power source circuit supply in the control mechanism.
FIG. 11 is a detailed diagram of a timer circuit in the control mechanism.

The common leads $L_1$ and $L_2$ are connected to the primary winding of a transformer TR, which transforms the commercially available voltage to a predetermined AC voltage of 24 V and supplies the transformed voltage to its secondary winding. The secondary winding of the transformer TR is connected to a power source circuit shown in FIG. 10. The power source circuit rectifies the AC input voltage of 24 V to supply it as two types of DC voltages VD and Vcc to the circuit shown in FIG. 11. The circuit in FIG. 11 is in the form of a timer circuit which controls the timing of energization and deenergization of the relay coils $R_{x1}$ and $R_{x2}$ in accordance with operation of the normally open relay switches $X_4$ and $X_{33}$ and the normally closed relay switch $X_{72}$.

The normally open relay switch $X_{33}$ and normally closed relay switch $X_{72}$ are arranged to set the input sides of inverters $IC_1$ and $IC_3$ to the level of the power source voltage VD when either one is opened and to set those input sides to the ground level when both are closed. When the input sides of inverters $IC_1$ and $IC_3$ are maintained at the ground level, the output sides of them are maintained at a high level (hereinafter referred to as "H level") so that the capacitors $C_3$ and $C_4$ are charged via resistors $r_9$ and $r_{16}$. When the input sides of inverters $IC_1$ and $IC_3$ are maintained at the VD level, the output sides of them are maintained at a low level (hereinafter referred to as "L level") so that the capacitors $C_3$ and $C_4$ are discharged via resistors $r_{10}$ and $r_{17}$. OP amplifiers ICa and ICb each act as a comparator and are connected at their non-inverting inputs (+) to one ends of the capacitors $C_3$ and $C_4$ and at their inverting inputs (−) to voltage-dividing circuits respectively consisting of resistors $r_{11}$ and $r_{12}$ and resistors $r_{18}$ and $r_{19}$. Each comparator produces an H-level output therefrom when the non-inverting input is maintained at a higher level than the inverting input and produces an L-level output therefrom when the non-inverting input is maintained at a lower level than the inverting input. The individual inverters $IC_2$ and $IC_4$ are arranged to effect positive feedback of the outputs of comparators ICa and ICb to the inverting inputs. Transistors $Q_3$ and $Q_4$ are arranged to be turned on in response to the H-level outputs of comparators ICa and ICb to energize the relay coils $R_{x1}$ and $R_{x2}$ and to be turned off in response to the L-level outputs of comparators ICa and ICb to deenergize the relay coils $R_{x1}$ and $R_{x2}$.

The normally open type relay switch $X_4$ is arranged to be closed when the power switch $S_1$ is closed, rendering the transistor $Q_1$ non-conductive. Since the capacitor $C_2$ is not yet charged yet immediately after the power switch $S_1$ is closed, the transistor $Q_2$ is maintained conductive to discharge the capacitors $C_3$ and $C_4$ to zero via double diodes $DD_2$ and $DD_4$. In this instance, the capacitor $C_2$ is charged for a short period of time to render the transistor $Q_2$ non-conductive. Thereafter, the transistors $Q_1$ and $Q_2$ are cut off from the other portion by the double diodes $DD_2$ and $DD_4$ so that the transistors $Q_1$ and $Q_2$ become conductive to discharge the capacitors $C_3$ and $C_4$ when the normally open relay switch $X_4$ is opened again.

Assuming that the power switch $S_1$ has been closed in a condition where the covers **19*a* and 19*b* are closed to maintain the cover switches $Sc_1$ and $Sc_2$ in their open positions, the relay coil $R_{x4}$ is energized to close the normally open relay switch $X_4$. In this instance, however, the water tank 37A** is not yet filled with water. Thus, the relay coil $R_{x3}$ is kept deenergized to maintain the normally open relay switch $X_{33}$ in its open position.

If the water level in discharge tank 60 is kept at or below the first water level to retain an amount of water in the water supply tank 40A, the relay coil $R_{x5}$ is energized to close the normally open type relay switch $X_5$. Thus, the water supply pump 52 is activated by the power applied via the normally closed relay switch $X_{32}$ to supply the water into the water tank 37A. When the water level in water tank 37A reaches the predetermined upper level, the normally open upper switch $FS_1$ of float switch FS is closed to energize the relay coil $R_{x3}$. This closes the normally open relay switch $X_{31}$ to open the normally closed relay switch $X_{32}$, thereby stopping the water supply pump 52. When the normally open relay switch $X_{31}$ is closed, the relay coil $R_{x3}$ to is maintained in its energized condition until the normally open lower float switch $FS_2$ is opened due to decrease of the water level in tank 37A to the predetermined lower level.

When the relay coil $R_{x3}$ is maintained in its energized condition to close the normally open relay switch $X_{33}$, the capacitor $C_3$ is charged so that the output of comparator ICa becomes an H level. As a result, the transistor $Q_3$ is turned on to energize the relay coil $R_{x1}$. Likewise, the capacitor $C_4$ is charged so that the output of the comparator ICb becomes an H level. As a result, the transistor $Q_4$ is turned on to energize the relay coil $R_{x2}$. In this instance, the time for the output of comparator ICa to change to the H level from the L level depends on a time constant which is mainly determined by the resistor $r_9$ and the capacitor $C_3$, while the time for the output of comparator ICb to change to the H level from the L level depends on a time constant which is mainly determined by the resistor $r_{16}$ and the capacitor $C_4$. Actually, the relay coil $R_{x1}$ is energized with a time delay of $T_1$ (e.g., one second) after the normally open relay switch $X_{33}$ is closed, while the relay coil $R_{x2}$ is energized with a time delay of $T_2$ (e.g., 60 seconds) (see FIG. 12).

Figure 9:
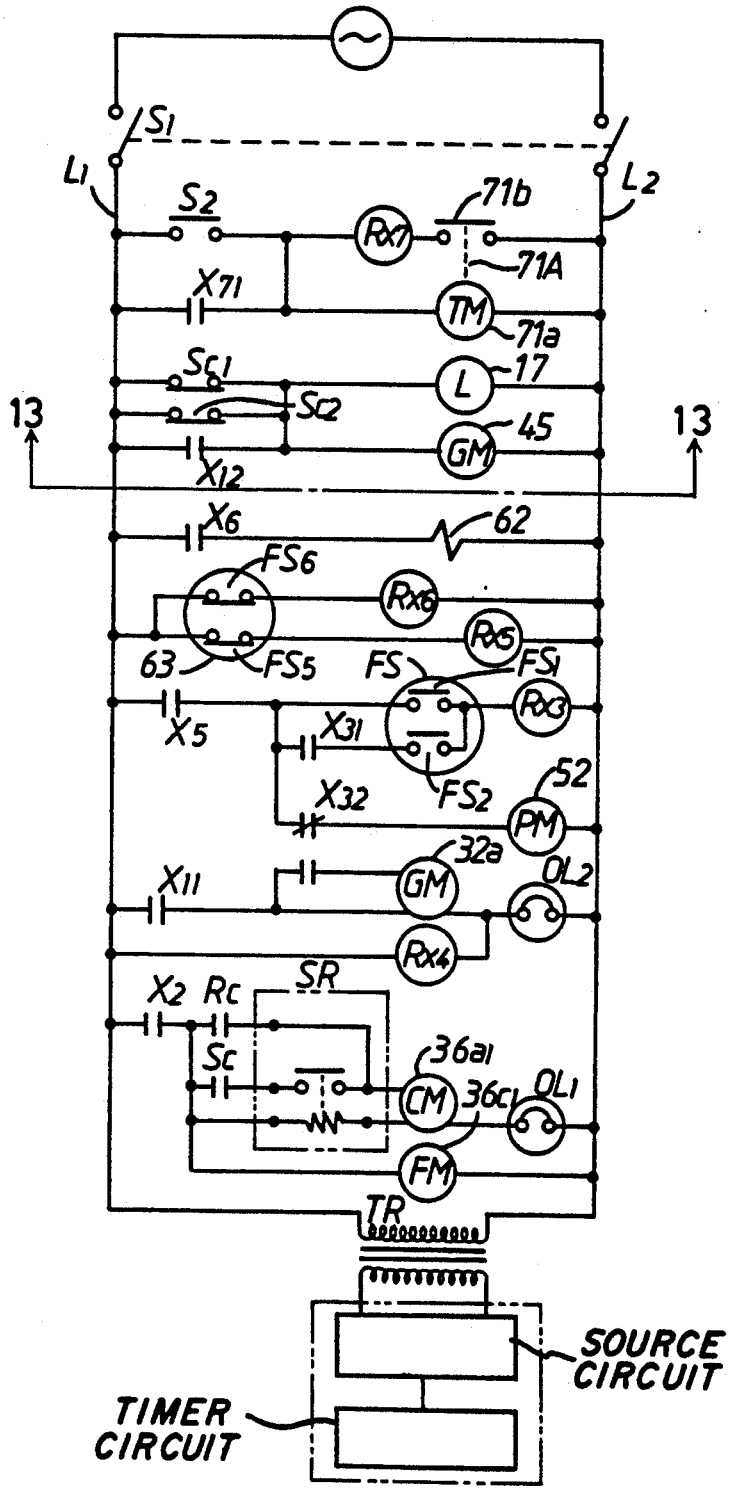
FIG. 9 is an electric circuit diagram of a control mechanism of the service counter.

When the normally open lower float switch $FS_2$ is opened due to decrease of the water level in tank 37A as shown in FIG. 9, the relay coil $R_{x3}$ is deenergized to open the normally open relay switch $X_{33}$. As a result, the outputs of inverters $IC_1$ and $IC_3$ become an L level to discharge the capacitors $C_3$ and $C_4$ through the resistors $r_{10}$ and $r_{17}$. Since the time constant for discharge of the capacitors is determined to be long, a predetermined amount of water is supplied to the water tank 37A before the potentials of the capacitors $C_3$ and $C_4$ drop to or below a predetermined value ($\frac{1}{3}$ Vcc), and the normally open upper float switch $FS_1$ is closed to energize the relay coil $Rx_3$. When the normally open relay switch $X_{33}$ is closed by energization of the relay coil $Rx_3$ (see TA in FIG. 12), the capacitors $C_3$ and $C_4$ are charged again so that the outputs of the comparators ICa and ICb are maintained at an H level to maintain the relay coils $R_{x1}$ and $R_{x2}$ in their energized conditions. If the relay switch $X_{33}$ is maintained in its open position for a long time due to suspension of the water supply or the like, the capacitors $C_3$ and $C_4$ are completely discharged to deenergize the relay coils $R_{x1}$ and $R_{x2}$ with delay of time $T_3$ and $T_4$ (see FIG. 12).

When the relay coil $R_{x1}$ is energized, the normally open relay switch $X_{11}$ is closed so that the auger drive motor 32*a* starts to rotate the rotary shaft 34*a* of auger 34A. At the same time, the normally open relay switch $X_{12}$ is closed so that the agitator drive motor 45 starts to rotate the agitator 41 and that the lighting equipment 17 is turned on. When the relay coil $R_{x2}$ is energized, the normally open relay switch $X_2$ is closed to activate the compressor drive motor 36*a*1 and fan motor 36*c*1. Thus, the evaporator 36*e* is supplied with the refrigerant circulating through the compressor 36*a*, condenser 36*b* and pressure reducing device 36*d* to form the water supplied to the housing body 33A into ice under cooling effect caused by evaporation of the refrigerant. The formed ice is scraped by the helical blade 34*b* of auger 34A and advance toward the extrusion head 35A where the ice is compressed and formed into chips of ice. The chips of ice are then supplied through the ice delivery port 33*a* into the main tank 21. The supplied chips of ice are agitated by rotation of the agitators 41 to be leveled and stored in the main tank 21.

When the ice making operation continues to store a predetermined quantity of chips of ice in the main tank 21, the chips of ice fall into the discharge tank 60 from the opening 71 of the overflow pipe 70, closing the proximity switch $S_2$ of the ice detector 75. As a result, the timer 71*a* starts to measure the predetermined time, and the normally open time limit switch 71*b* is closed. This energizes the relay coil $R_{x7}$, closing the normally open type relay switch $X_{71}$. When the relay switch $X_{71}$ is closed, the timer 71*a* is maintained in its energized condition to continue the measurement of the predetermined time even after the main switch $S_2$ has been opened, thereby maintaining the time limit switch 71*b* in its closed position and the relay coil $R_{x7}$ in its energized condition.

When the relay coil $R_{x7}$ is energized, the normally open relay switch $X_{72}$ is opened to discharge the capacitors $C_3$ and $C_4$ through the resistors $r_{10}$ and $r_{17}$. Thus, the relay coils $R_{x2}$ and $R_{x1}$ are respectively deenergized with the delay times $T_4$ and $T_3$ to deactivate the compressor drive motor 36*a*1 and fan motor 36*c*1 and to deactivate the auger drive motor 32*a* and agitator drive motor 45 so as to end the ice making operation (see FIG. 12).

Consequently, the ice level A in the main tank 21 is kept at the predetermined level. In such a situation, the ice storage type display apparatus is used with the food and drink containing service container Bb placed in the support container Ba. Restart of the ice making operation will be conducted after measurement of a predetermined time (e.g., 60 minutes) set by the timer 71*a*. In this instance, the time limit switch 71*b* is opened after lapse of the predetermined time to deenergize the relay coil $R_{x7}$ thereby to close the normally close relay switch $X_{72}$, and the relay coils $R_{x1}$ and $R_{x2}$ are energized to activate the compressor drive motor 36*a*1, auger drive motor 32*a* and agitator drive motor 45. Thereafter, the ice making operation will be repeated in the same cycle.

When the covers 19*a* and 19*b* of the service counter are opened to display food and drink contained in the service containers Bb. The cover switches $Sc_1$ and $Sc_2$ at the upper edge 20*b* of the main tank 21 are closed to activate the agitator drive motors 45 and to turn on the lighting equipment 17. If one of the front and rear covers 19*a* and 19*b* is opened, either the cover switch $Sc_1$ or $Sc_2$ is closed to activate the agitator drive motors 45 and to turn on the lighting equipment 17 in the same manner as described above. Thus, the agitators 41 are driven by the respective drive motors 45 to agitate the stored chips of ice regardless of activation of the ice supply device 30A. In this instance, the stored chips of ice are moved around in the main tank 21 to provide an excellent display effect as well as refrigerate food and drink contained in the service containers Bb.

When the normally open time limit switch 71b is opened upon lapse of the predetermined time measured by the timer 71a, the compressor drive motor 36a1 and auger drive motor 32a are activated to restart the ice making operation, supplying chips of ice into the main tank 21 via the ice delivery port 33a. In this instance, the agitators 41 are rotated regardless of the ice making operation. When the power switch $S_1$ is opened to finish the operation of the service counter, the capacitors $C_3$ and $C_4$ are discharged via the double diodes $DD_2$ and $DD_4$, instantaneously stopping the operation of the service counter.

From the above description, it will be understood that in the third embodiment the ice supply device 30A is operated to automatically supply chips of ice to the service counter and that the agitating device 40 is operated to automatically agitate the stored chips of ice to level in the service counter. With the above arrangement, a predetermined quantity of ice can always be stored in the service counter without requiring any manual labor, and an attractive display effect can be obtained by rotational movement of the stored chips of ice during operation of the display apparatus. In preparation stage of the service counter where the covers 19a and 19b are closed, the agitators 41 are driven under control of the control device 70A only during activation of the ice supply device 30a to level the chips of ice supplied into the main tank 21. In a condition where the covers 19a and 19b are opened to display the food and drink, the agitators 45 are always driven under control of the control device 70A. Accordingly, the agitators 45 are driven only when needed to effect the display effect and to prevent the chips of ice from so-called arching. This is useful to prevent crash of ice chips and to ensure stable operation of the service counter for a long period of time.

Figure 13:
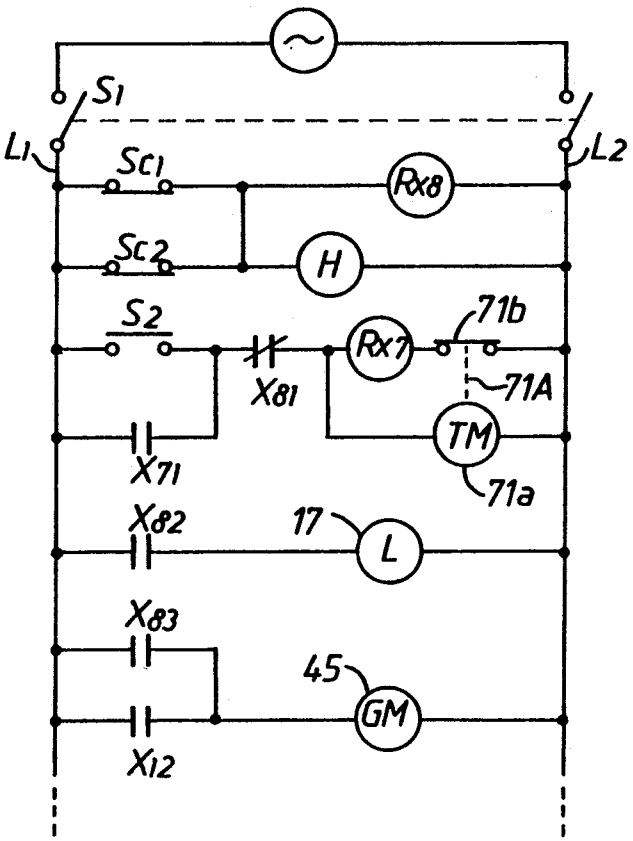
FIG. 13 is a circuit diagram illustrating a modification of the electric circuit.

A modification of the third embodiment will now be described with reference to FIG. 13. In this modification, the above portion of the electric control circuit indicated by a dot and dash line in FIG. 9 is modified as shown in FIG. 13, wherein a relay coil $R_{x8}$ is associated with a normally closed relay switch $X_{81}$ and normally open relay switches $X_{82}$ and $X_{83}$. The relay coil $R_{x8}$ has one end connected via a parallel circuit of the cover switches $Sc_1$ and $Sc_2$ to the common lead $L_1$ and the other end connected to the common lead $L_2$ and is arranged to be energized when the covers 19a and 19b are opened. A heater H is connected in parallel with the relay coil $R_{x8}$ to be energized when the covers 19a and 19b are opened.

The normally close relay switch $X_{81}$ has one end connected via a parallel circuit of the proximity switch $S_2$ of ice detector 75 and the normally open relay switch $X_{71}$ to the common lead $L_1$ and the other end connected via the timer 71a to the common lead $L_2$. The relay coil $R_{x7}$ and the normally open time limit switch 71b are connected in parallel with the timer 71a. The lighting equipment 17 has one end connected via the normally open relay switch $X_{82}$ to the common lead $L_1$ and the other end connected to the common lead $L_2$ and is arranged to be turned on when both the covers 19a and 19b are opened. The agitator drive motor 45 has one end connected via a parallel circuit of the normally open relay switches $X_{83}$ and $X_{12}$ to the common lead $L_1$ and the other end connected to the common lead $L_2$ and is arranged to be activated when both the covers 19a and 19b are opened. The mechanical structure of the display apparatus is the same as the one shown in FIG. 5 except that the heater H (not shown) is provided to melt the ice in the discharge tank 60.

When the covers 19a and 19b are closed in preparation of the service counter, the cover switches $Sc_1$ and $Sc_2$ are opened. In such a condition, the relay coil $R_{x8}$ is maintained in its deenergized condition to maintain the normally close relay switch $X_{81}$ in its closed position so that the timer circuit 71A and the relay coil $R_{x7}$ are controlled by operation of the proximity switch $S_2$ as in the electric control circuit shown in FIG. 9. Since the normally open relay switch $X_{83}$ is also maintained in its open position, the agitator drive motor 45 is controlled by the normally open relay switch $X_{12}$ as in the electric control circuit shown in FIG. 10. This modification however differs from the third embodiment in that the lighting equipment 17 will not be turned on unless the normally open relay switch $X_{82}$ is closed.

When the covers 19a and 19b are opened to display the food and drink contained in the service containers, the cover switches $Sc_1$ and $Sc_2$ are closed to energize the relay coil $R_{x8}$ thereby to open the normally closed relay switch $X_{81}$. As a result, the timer 71a is cut off from the common leads $L_1$ and $L_2$ to be ineffective, maintaining the relay coil $R_{x7}$ in its deenergized condition. In this instance, the normally open relay switch $X_{83}$ is closed to activate the agitator drive motor 45, and the normally open relay switch $X_{82}$ is closed to turn on the lighting equipment 17. During deenergization of the relay coil $R_{x7}$, the normally closed relay switch $X_{72}$ is maintained in its closed position to energize the relay coils $R_{x1}$ and $R_{x2}$, activating the auger drive motor 32a and compressor drive motor 36a1 to supply chips of ice into the main tank 21. Thus, the chips of ice are always supplied from the ice delivery port 33a, the agitators 41 are always driven to agitate the supplied ice chips, and the ice chips supplied in excess fall in the discharge tank 60 from the opening 71 of overflow pipe 70. Accordingly, the chips of ice are dynamically moved around in the main tank 21 to provide an excellent display effect. In addition, the heater H in the discharge tank 60 is energized in response to closing of the cover switches $Sc_1$ and $Sc_2$ to melt the pieces of ice falling through the overflow pipe 70 and to discharge the resultant water outwardly for preventing accumulation of the ice in the discharge tank 60.

From the above description, it will be understood that in the modification the dynamic change in movement of the ice chips is very effective to more enhance the display effect in addition to the same effect as obtained in the third embodiment. In the modification, the lighting equipment 17 is turned on only when light illumination is needed for display. This is useful to avoid waste of the power due to the user's carelessly forgetting to turn off the lighting equipment 17.

Figure 14:
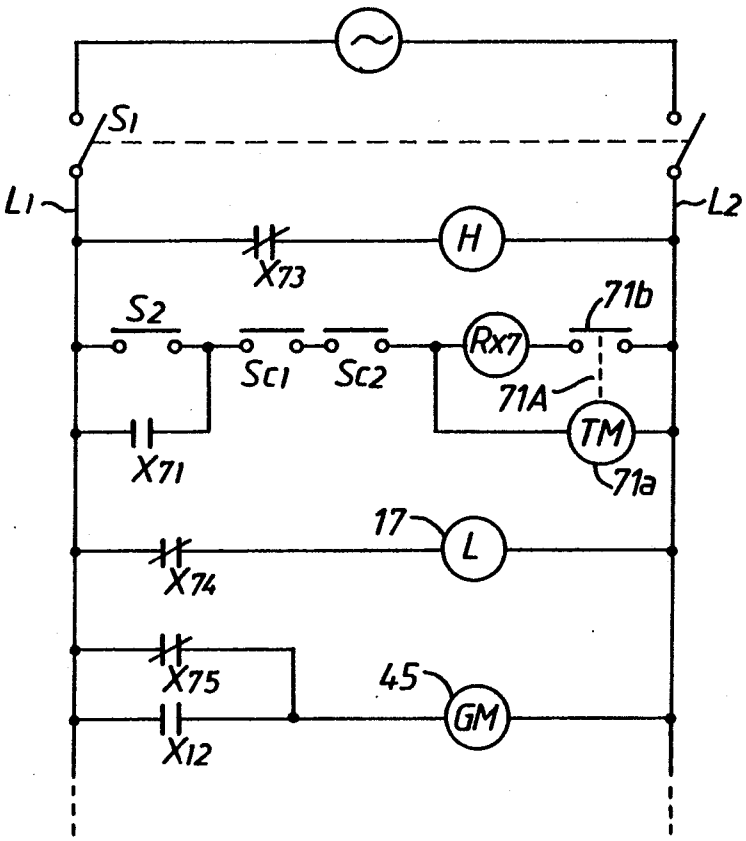
FIG. 14 is a circuit diagram illustrating another modification of the electric circuit.

Another modification of the third embodiment will be further described with reference to FIG. 14. In this modification, the above part of the electric control circuit indicated by a dot and dash line in FIG. 9 is modified as shown in FIG. 14, wherein the heater H has one end connected via a normally closed relay switch $X_{73}$ to the common lead $L_1$ and the other end connected to the common lead $L_2$. The relay switch $X_{73}$ is associated with a relay coil $R_{x7}$ to be opened by energization of the relay coil $R_{x7}$. In this modification, the cover switches $Sc_1$ and $Sc_2$ are connected in series in place of the normally closed relay switch $X_{81}$ shown in FIG. 13. Unlikely those in the third embodiment, the cover switches $Sc_1$ and $Sc_2$ are arranged to be closed when the covers 19a and 19b are closed and to be opened when both the covers 19a and 19b are opened. In addition, normally close type relay switches $X_{74}$ and $X_{75}$ are provided in place of the normally open relay switches $X_{82}$ and $X_{83}$ in FIG. 13. The relay switches $X_{74}$ and $X_{75}$ are associated with the relay coil $R_{x7}$ to be opened by energization of the relay coil $R_{x7}$. In such an arrangement as described above, the covers 19a and 19b are closed in preparation of the service counter so that the cover switches $Sc_1$ and $Sc_2$ are closed to energize the relay coil $R_{x7}$. In this instance, the relay switches $X_{73}$, $X_{74}$ and $X_{75}$ are opened during energization of the relay coil $R_{x7}$. When the covers 19a and 19b are opened for display of the food and drink, the cover switches $Sc_1$ and $Sc_2$ are opened to deenergize the relay coil $R_{x7}$, closing the relay switches $X_{73}$, $X_{74}$ and $X_{75}$. Thus, the operation of the service counter can be controlled in the same manner as in the previous modification.

With regard to the heater H used in the above modifications, the conduit of the refrigeration circuit 36 at its high pressure side may be laid in the discharge tank 60 to melt the pieces of ice in the discharge tank 60.

Although the foregoing description has been made with reference to the case where the ice making machine in use is of an auger type, the present invention is not limited to this particular type, but may be applied to other types of ice making machines.

What is claimed is:

1. An ice storage type food service counter comprising:

an ice tank arranged to store an amount of chips of ice wherein food and drink is placed upon or above the stored chips of ice for refrigeration, said ice tank having an upward opening for display of the food and drink and a discharge hole at a bottom thereof for discharging water of the melted ice therethrough;

an ice supply device coupled with said ice tank for producing chips of ice and supplying the same into said ice tank; and an agitating device arranged within said ice tank for agitating and leveling the chips of ice stored in said ice tank.

2. An ice storage type food service counter recited in claim 1, further comprising means for deactivating said ice supply device when a level of ice supplied into said ice tank exceeds a predetermined level, and wherein said agitating device comprises at least one agitator disposed within said ice tank in such a manner that a lower portion of the agitator is positioned in the chips of ice stored in said ice tank to agitate and level the stored chips of ice.

3. An ice storage type food service counter comprising:

an ice tank arranged to store an amount of chips of ice and having a discharge hole at a bottom;

an ice supply device for automatically producing chips of ice and supplying the same into the ice tank;

at least one drive shaft, penetrating the bottom of the ice tank from below in a liquid-tight manner to protrude into the ice tank and arranged to be rotated by a drive motor;

at least one agitator detachably mounted on an upper end of the drive shaft in such a manner that a lower portion of the agitator is positioned in the chips of ice stored in the ice tank to agitate and level the stored chips of ice when driven by rotation of the drive shaft; and a container supported on the agitator to be placed on the chips of ice for display and capable of containing drink and food therein.

4. An ice storage type food service counter comprising:

an ice making means for forming water into chips of ice;

an ice tank arranged to store the chips of ice supplied from the ice making means and to contain food and drink on the stored ice for refrigeration;

agitating means arranged to agitate the chips of ice stored in the ice tank;

a cover arranged to open and close the ice tank;

detecting means for detecting when the cover is closed and for releasing the detection when the cover is opened; and control means for controlling the agitating means in such a manner as to activate the agitating means to perform agitation of the chips of ice only in operation of the ice making means when closure of the cover is detected by the detecting means and to activate the agitating means to perform agitation of the chips of ice while the detection is being released by the detecting means.

5. An ice storage type food service counter comprising:

an ice tank arranged to store an amount of chips of ice so as to place food and drink on or above the stored chips of ice for refrigeration, said ice tank having an upward opening for display of the food and drink and a discharge hole at a bottom for discharge water of the melted ice therethrough;

an ice supply device arranged under said ice tank for producing chips of ice and for supplying the chips of ice into said ice tank;

a vertical ice delivery cylinder mounted on said ice supply device and extending into the interior of said ice tank for delivering the chips of ice from said ice supply device into said ice tank; and an agitating device arranged within said ice tank for agitating and leveling the chips of ice stored in said ice tank.

6. An ice storage type food service counter as recited in claim 5, further comprising:

a discharge tank arranged under said ice tank and connected to the discharge hole of said ice tank to receive the water discharged therefrom;

a vertical overflow pipe extending from said discharge tank into an interior of said ice tank and having an upper end located lower than an upper edge of said ice tank;

detection means for detecting chips of ice falling into said discharge tank from said ice tank through said overflow pipe; and electric control means for deactivating said ice supply device in response to operation of said detection means.

7. An ice storage type food service counter as recited in claim 6, wherein a water supply tank is combined with said discharge tank in such a manner as to communicate therewith, said water supply device being connected to said ice supply device for supplying ice making water therefrom to said ice supply device.

8. An ice storage type food service counter as recited in claim 5, wherein said agitating device comprises a plurality of equally spaced agitators disposed within said ice tank wherein each lower portion of the agitators is positioned in the chips of ice stored in said ice tank to agitate and level the stored chips of ice.

9. An ice storage type food service counter as recited in claim 8, wherein a container is detachably supported on each of said agitators to be placed on the chips of ice for containing food and drink therein for display.

10. An ice storage type food service counter comprising:

an ice tank arranged to store an amount of chips of ice so as to place food and drink on or above the stored chips of ice for refrigeration, said ice tank having an upward opening for display of the food and drink and a discharge hole at a bottom for discharging water of the melted ice therethrough;

an ice supply device assembled with said ice tank for automatically producing chips of ice and supplying the same into said ice tank;

at least one drive shaft penetrating the bottom of said ice tank from below in a liquid-tight manner to protrude into said ice tank and arranged to be rotated by a drive motor;

at least one agitator mounted on an upper end of said drive shaft in such a manner that a lower portion of the agitator is positioned in the chips of ice stored in said ice tank to agitate and level the stored chips of ice when driven by rotation of said drive shaft; and a container supported on said agitator to be placed on the chips of ice for containing drink and food therein for display.

* * * * *